US008936392B2

(12) United States Patent
McGuire et al.

(10) Patent No.: US 8,936,392 B2
(45) Date of Patent: Jan. 20, 2015

(54) HYDRODYNAMIC CAVITATION DEVICE

(71) Applicant: Ecosphere Technologies, Inc., Stuart, FL (US)

(72) Inventors: Dennis McGuire, Stuart, FL (US); Dennis McGuire, Jr., Stuart, FL (US)

(73) Assignee: Ecosphere Technologies, Inc., Stuart, FL (US)

( * ) Notice: Subject to any disclaimer, the term of this patent is extended or adjusted under 35 U.S.C. 154(b) by 353 days.

(21) Appl. No.: 13/632,535

(22) Filed: Oct. 1, 2012

(65) Prior Publication Data

US 2013/0088935 A1 Apr. 11, 2013

Related U.S. Application Data

(63) Continuation-in-part of application No. 12/816,014, filed on Jun. 15, 2010, now abandoned.

(51) Int. Cl.
*B01F 5/06* (2006.01)

(52) U.S. Cl.
CPC ..... *B01F 5/0688* (2013.01); *B01F 5/0619* (2013.01); *B01F 2005/0636* (2013.01)
USPC ..... 366/337; 366/341

(58) Field of Classification Search
CPC ..... B01F 5/0688
USPC ..... 366/337, 341
See application file for complete search history.

(56) References Cited

U.S. PATENT DOCUMENTS

| | | | | |
|---|---|---|---|---|
| 846,751 | A * | 3/1907 | Melvin | 366/9 |
| 3,337,194 | A * | 8/1967 | Zavasnik et al. | 366/337 |
| 3,652,061 | A | 3/1972 | CHisholm | |
| 4,207,009 | A * | 6/1980 | Glocker | 366/337 |
| 4,511,258 | A | 4/1985 | Federighi et al. | |
| 4,929,088 | A * | 5/1990 | Smith | 366/337 |
| 4,936,689 | A | 6/1990 | Federighi et al. | |
| 5,215,375 | A | 6/1993 | Ditzler et al. | |
| 5,492,654 | A | 2/1996 | Kozjuk et al. | |
| 6,830,370 | B1 | 12/2004 | Uematsu | |
| 2011/0305104 | A1 | 12/2011 | McGuire et al. | |

FOREIGN PATENT DOCUMENTS

| | | |
|---|---|---|
| DE | 2810648 | 9/1979 |

OTHER PUBLICATIONS

Moholokar, V et al, "Hydrodynamic cavitation for sonochemical effects", Chem Eng Dept, Univ of Bombay, India, 1:2:53-56, (Mar. 6, 1999).

* cited by examiner

*Primary Examiner* — David Sorkin
(74) *Attorney, Agent, or Firm* — McHale & Slavin, P.A.

(57) ABSTRACT

An advanced hydrodynamic cavitation device formed from a cylindrical tube having a flow through chamber. The chamber has a series of stages with each stage formed from at least three plates spaced annularly and extending radially inward at an oblique angle with respect to the longitudinal axis of the flow through chamber. Each plate has shear inducing side edges and a plurality of orifices with shear inducing edges. The orifices are arranged perpendicular to the plates and shaped to control the velocity of the fluid. An unrestricted passageway exists along the central axis of the flow through chamber to provide a constant flow for continuous flushing of suspended solids to prevent clogging. Additionally, the passageway will facilitate the insertion of a pressure cleaning tube without requiring that the device be disassembled.

15 Claims, 3 Drawing Sheets

HYDRODYNAMIC CAVITATION DEVICE

REFERENCE TO RELATED APPLICATION

In accordance with 37 C.F.R. 1.76, a claim of priority is included in an Application Data Sheet filed concurrently herewith. Accordingly, under 35 U.S.C. §119(e), 120, 121, and/or 365(c) the present invention claims priority, as a continuation-in-part of U.S. patent application Ser. No. 12/816,014, filed Jun. 15, 2010, entitled "HYDRODYNAMIC CAVITATION DEVICE". The contents of which the above referenced application are incorporated herein by reference.

FIELD OF THE INVENTION

This invention relates to fluid handling and, more particularly, to an apparatus for creating hydrodynamic cavitations in a fluid stream.

BACKGROUND OF THE INVENTION

Hydrodynamic cavitation is the result of a flow constriction wherein a liquid falls below the vapor pressure and forms vapor-filled gas bubbles. If the static pressure then increases and exceeds the vapor pressure, these vapor-filled gas bubbles collapse implosively. During the fluid flow movement, the pressure at certain points decreases to a magnitude under which the fluid reaches a boiling point for this pressure, then a great number of vapor-filled cavities and bubbles are formed. As the vapor-filled bubbles and cavities move together with the fluid flow, these bubbles and cavities may move into an elevated pressure zone. Where these bubbles and cavities enter a zone having increased pressure, vapor condensation takes place within the cavities and bubbles, almost instantaneously causing the cavities and bubbles to collapse, creating very large pressure impulses. The magnitude of the pressure impulses within the collapsing cavities and bubbles may reach ultra high pressures implosions leading to the formation of shock waves that emanate from the point of each collapsed bubble. The cavitation and associated effects are useful mixing, emulsifying and dispersing various components in a flowing liquid. The mixing action is based on a large number of forces originating from the collapsing or implosion of cavitation bubbles.

A hydrodynamic cavitation device may appear similar to an in-line fluid flow static mixers, however, to one skilled in the art a static mixer simply consists of mixing baffles arranged so that when a material is discharged from one baffle, it discharges with a swirling action and strikes the downstream baffle. The fluid flow divides before it passes on to the next succeeding baffle, which again divides the flow into various streams. U.S. Pat. Nos. 4,511,258 and 4,936,689 disclose conventional static mixers. However, such mixers cannot be converted to provide a hydrodynamic cavitation device and are not economically feasible in situations wherein a high flow rate and rapid mixing is required.

Hydrodynamic cavitation takes place during the flow of a liquid under controlled conditions through predefined geometries. The phenomenon results in the formation of hollow spaces which are filled with a vapor gas mixture in the interior of a fast-flowing liquid flow or at peripheral regions of a fixed body which is difficult for the fluid to flow around and the result is a local pressure drop caused by the liquid movement. At a particular velocity the pressure may fall below the vapor pressure of the liquid being pumped, thus causing partial vaporization of the cavitating fluid. During the reduction of pressure, gases which are liberated dissolve in the cavitating liquid. These gas bubbles also oscillate and thus give rise to the pressure and temperature pulses.

It is known that devices exist in the art which utilize the passage of a hydrodynamic flow through a cylindrical flow-through chamber which has a series of baffles confronting the direction of hydrodynamic flow to produce varied cavitation effects. The baffles cause a localized contraction of the flow as the fluid flow confronts the baffle element thus increasing the fluid flow pressure. As the fluid flow passes the baffle, the fluid flow enters a zone of decreased pressure downstream of the baffle element thereby creating a hydrodynamic cavitation field. U.S. Pat. No. 5,492,654 discloses a cylindrical flow-through chamber having internally disposed baffles. In this disclosure the upstream baffle elements have a larger diameter than the downstream baffle elements. Such a device is utilized in an attempt to create and control hydrodynamic cavitation in fluids wherein the position of the baffle elements is variable. The study of hydrodynamic cavitation based up the Rayleigh-Plesset equation has been documented in the paper Hydrodynamic Cavitation for Sonochemical Effects, written by the Chemical Engineering Department, University of Bombay, India (1999).

Although the hydrodynamic cavitation devices exist in the prior art, there is nevertheless a need for improvement in many respects to provide a fluid shearing effect and the ability to modify cavitation effects by use of shear plates installed external the flow tube.

SUMMARY OF THE INVENTION

Disclosed is an advanced hydrodynamic cavitation device for use in high contaminant flow situations where certain cavitation intensities are required. The device is formed from a cylindrical tube having a flow-through chamber constructed and arranged to cause hydrodynamic cavitation. The flow-through chamber includes a series of stages, each stage is formed with at least three triangular shaped plates extending radially inward at an oblique angle to the chamber. The arrangement of the plates allows space for an unrestricted passageway along the central axis. Each plate has a plurality of orifices designed to control the velocity of fluid flow. Each orifice and each plate have sharp edges to induce shearing.

Essentially, the instant invention is based on mixing vanes attached in a novel way to the outside of the wall of a tube that inserts in to a pipe like blades in a blender. Fluid flows around the wall of the pipe (inertia) and the blades can munch and chop bacteria flocs of colonies on all of the sharp edges of each blade in any direction. Each set of three blades are rotated to be offset of the first set of blades creating a blender effect where instead of the blades moving in a normal blender, the fluid is moved through the tube in a blender effect. Unlike static mixers, sharp edges on the outside edges and inside edges are constructed and arranged to create micro bubbles to create OH-radicals. All of the edges are super sharp and each blade is created as an individual knife blade. This instant device kills biofilms by smashing their micro and macro colonies apart and creating OH— radicals, ie. H2O2, during bubble collapse. The result is a reduction of bacteria load prior to further treatment such as the Applicant's process system that includes ozone, ultrasonic and electro-oxidation.

Accordingly, it is an objective of the instant invention to increase the amount of effluent saturation by creation of OH-radicals.

It is a further objective of the instant invention is to create bacteria cell wall disruption and oxidation of contaminants.

It is yet another objective of the instant invention to place the plates in the flow through chamber at oblique angles to the flow in order to increase the number and intensity of the cavitations.

It is, a still further objective of the invention to provide a hydrodynamic cavitation device with an unrestricted passageway along the central axis to provide continuous flushing of suspended solids to prevent clogging as well as facilitate the insertion of a cleaning device.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
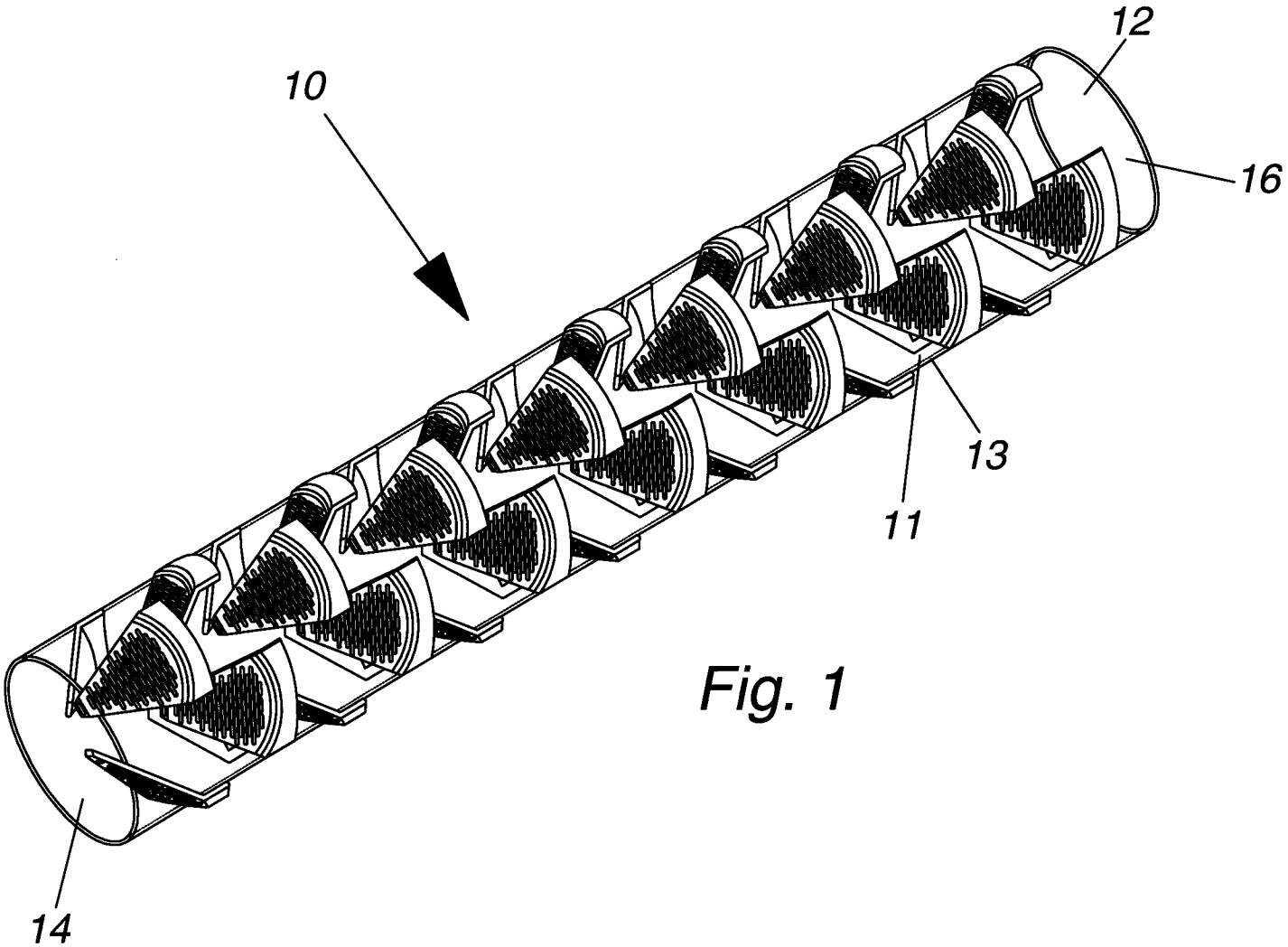
FIG. 1 is a perspective view of the enhanced hydrodynamic cavitation device.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

In many gas fields, gas is trapped in shale formations that require stimulating the well using a process known as fracturing or fracing. The fracing process uses large amounts of water and large amounts of particulate fracing material (frac sands) to enable extraction of the gas from the shale formations. After the well site has been stimulated the water pumped into the well during the fracing process is removed. The water removed from the well is referred to as flowback fluid or frac water. A typical fracing process uses millions of gallons of water to fracture the formations of a single well. Recycling of frac water has the benefit of reducing waste products, namely the flowback fluid, which will need to be properly disposed. On site processing equipment, at the well, is the most cost effective and environmentally friendly way of recycling this natural resource.

A horizontal well takes approximately 4.5 million gallons of fresh water for the fracture process. This water may be available from local ponds and streams, or purchased from a municipal water utility. The water is typically delivered to the well site by tanker trucks, which carry roughly five thousand gallons per trip. During flowback operations, approximately 300 tanker trucks are used to carry away more than one million gallons of flowback water per well for offsite disposal.

The Applicant has been awarded patents for unique processes that employ a cost-effective onsite cavitation reactor that combines ozone, hydrodynamic cavitation, ultra-sound and electro-precipitation (see U.S. Pat. Nos. 7,699,994; 7,699,988; and 7,785,470 the contents of which are herein incorporated by reference). The frac water is pressurized and injected with ozone during the process. One of the purposes of the advanced hydrodynamic cavitation device is to increase the amount of effluent saturation with the oxidizing gas ozone.

Figure 2:
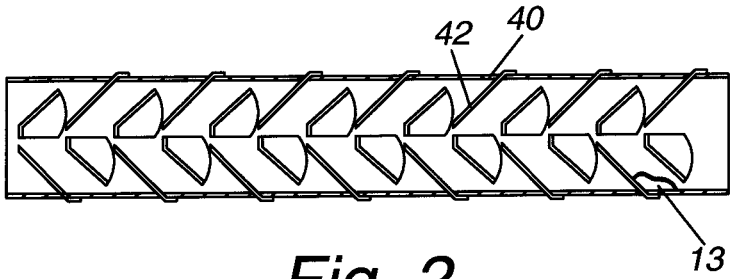
FIG. 2 is a cross-sectional top view thereof.
Figure 3:
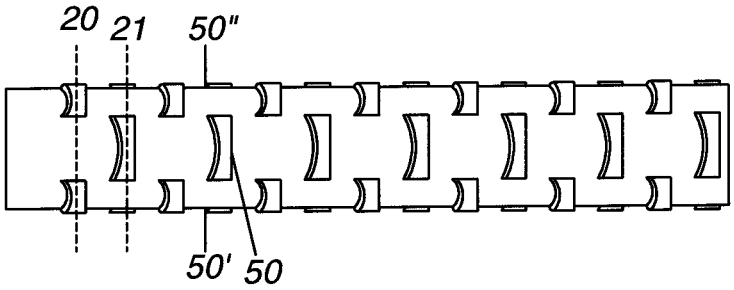
FIG. 3 is a top view thereof.
Figure 4:
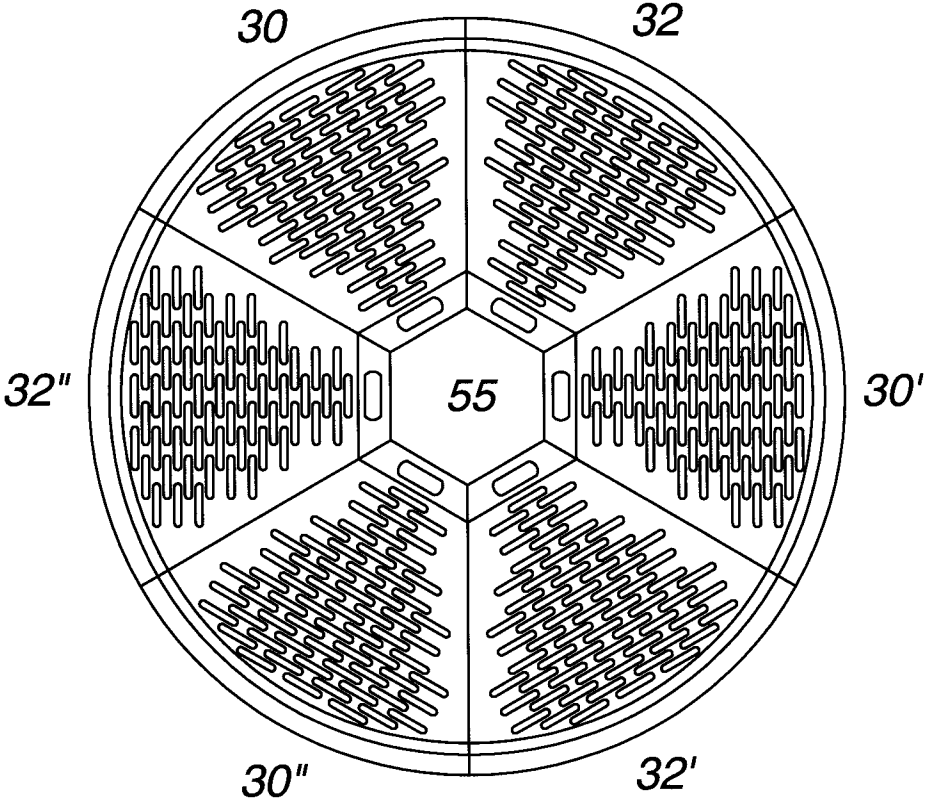
FIG. 4 is a cross-sectional view of the arrangement of the plates within the enhanced hydrodynamic cavitation device.

Referring now to FIGS. 1-6, wherein like components are numbered consistently throughout, FIG. 1 illustrates a device for enhancing hydrodynamic cavitation in fluids 10 having a dependent tube member with an inlet 12 and outlet 14 with a continuous sidewall that forms a flow-through chamber 16. The flow through chamber 16 has an inner surface 11 and an outer surface 13. FIGS. 2-4 illustrate, at least two stages are comprised of stage 20 having at least three plates 30, 30' and 30" and stage 21 having at least three plates 32, 32' and 32" spaced annularly and secured to said flow through chamber 16 extending radially inward at an oblique angle (B) with respect the longitudinal axis (A) of said flow-through chamber 16. The plates are further defined as having a top surface 40, a bottom surface 42, a plurality of side surfaces 44, 44' and 44" and a plurality of orifices 46. The side surfaces 44, 44' and 44" are constructed and arranged to form fluid shear inducing edges. The orifices 46 are constructed and arranged to form shear inducing edges. The passage of a fluid through the flow-through chamber 16 results in the creation of a hydrodynamic cavitation field as a result of fluid shearing along said shear inducing edges and said orifices in each plate. The orifices 46 are positioned in each plate in a predetermined size, number and pattern calculated to provide optimum cavitation with minimal pressure loss. Low iron content stainless steel, titanium, or certain thermoplastics is suitable for the high flow operation with minimal erosion to the plate edges.

Figure 5:
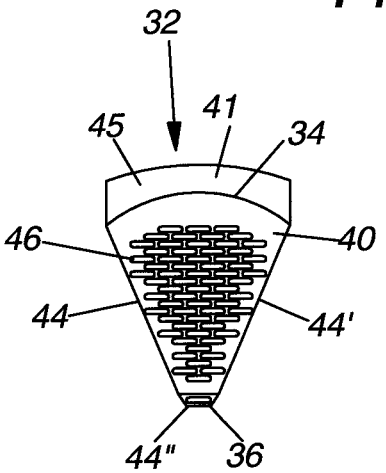
FIG. 5 is a top view of one of the plates.
Figure 6:
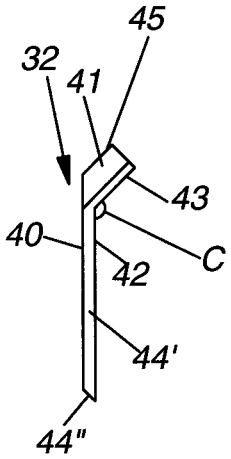
FIG. 6 is a side view of one of the plates.

In FIGS. 5 and 6, each of the plates is further defined as having a proximate end 34 and a distal end 36. A depending flange 41 having an inner surface 43 and an outer surface 45 is constructed and arranged to attach at a predetermined angle (C) to said proximate end 34 of said plate. In a preferred embodiment, each flange is constructed and arranged in a triangular configuration and integrally formed. The inner surface 43 of each depending flange is further define as having a substantially conjugate shape as said outer surface 13 of said flow-through chamber 16.

The flow through chamber 16 includes at least three slots 50, 50' and 50" spaced annularly in each stage. The slots 50, 50' and 50" are further defined as having a substantially conjugate shape as the proximate end 34 of each plate. The plates extend radially inward through said slots at an oblique angle (B) with respect to the longitudinal axis (A) of said flow through chamber 16. Each depending flange 41 is positioned to cooperate with the outer surface 13 of said flow through chamber 16. Each plate is attached by welding the flange to the outer surface of said flow through chamber but could be attached with a pinion piston or be frictionally secured by use of an interference fit. Unique to this invention the ability to remove plates for maintenance or change of cavitational properties. By insertion of the plates from an external position, a plate can be removed and inspected for wear without having to remove the entire tube. Further, plates of different size and configuration can be used during the initial manufacturing stage or as a replacement in the field.

Hydrodynamic cavitation occurs as the result of the velocity variation in flow due to the changing geometry of the path of fluid flow. Desired cavitation intensities are obtained through a combination of the orifice shape and the orifice placement in the flow through chamber 16. Each plate has a plurality of orifices 46 that are constructed and arranged perpendicular to the top surface 40 and positioned at an angle to the fluid flow to create a constriction area. The flow velocity in a local constriction area is increased while the pressure decreases resulting in voids formed in the fluid flow that create cavitation bubbles. The orifices 46 are flow through and formed with sharp edges. The exit side of each edge will form vena contracta eddys and fluid shearing. Cavitation is produced at the fluid shear layer. The liquid vaporized at vena contracta downstream is proportional to the area of the shear layer.

Each said orifice 46 is sized to control the velocity of fluid flow and provide a predetermined pressure drop. The fluid passes through each orifice 46 and enters into an increased pressure area with a reduced velocity causing collapse of the bubbles which produces localized high energy conditions including high pressures and high temperatures. When gases are present, high temperatures occur as the cavitation bubbles collapse and plasmas are created. The plasmas may emit ultraviolet light and the ultraviolet light may be emitted as a pulse. Emission of this ultraviolet light may be called cavitational luminescence. The ultraviolet light may irradiate oxidizing agents contained within or associated with the cavitation bubbles. Irradiating oxidizing agents may produce ionization of the oxidizing agents. Irradiating oxidizing agents may produce hydroxyl radicals. The hydroxyl radicals may contact and react with organic compounds in the fluid or solution in which the cavitation bubbles are produced. For example, these reactions may destroy or degrade the organic compounds, through breakage of chemical bonds within the compounds. These reactions may produce partial oxidation of the organic compounds. These reactions may produce complete oxidation of the organic compound, to carbon dioxide and water.

The distal end of the plates 36 is positioned in the flow-through chamber 160 to create an unrestricted passageway 55 along the central axis (A) of said flow through chamber to provide a constant flow for continuous flushing of suspended solids to prevent clogging. Additionally, the passageway will facilitate the insertion of a pressure cleaning tube without requiring that the device be disassembled.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A device for enhancing hydrodynamic cavitation in fluids comprising: a dependent tube member having an inlet and outlet with a continuous sidewall forming a flow-through chamber; said flow-through chamber having an inner surface and an outer surface; a plurality of plate stages, each plate stage having at least three plates spaced annularly and secured to said tube member at an oblique angle with respect the longitudinal axis of said flow-through chamber, said plates further defined as having a top surface securable to said outer surface of said flow-through chamber and a bottom surface of each plate extending radially inward through a slot placed in said sidewall, said plate having a plurality of side surfaces and a plurality of orifices, said side surfaces constructed and arranged to form fluid shear inducing edges, said orifices constructed and arranged to form shear inducing edges; wherein passage of a fluid through said flow-through chamber results in the creation of a hydrodynamic cavitation field through fluid shearing along said shear inducing edges and said orifices in each plate.

2. The device for enhancing hydrodynamic cavitation in fluids according to claim 1, wherein said plates are further defined as having a proximate end and a distal end.

3. The device for enhancing hydrodynamic cavitation in fluids according to claim 1, wherein a depending flange having an inner surface and an outer surface is constructed and arranged to attach at a predetermined angle to said proximate end of said plate.

4. The device for enhancing hydrodynamic cavitation in fluids according to claim 1, wherein said top surface, said bottom surface, said side surfaces and said depending flange of said plates are integrally formed.

5. The device for enhancing hydrodynamic cavitation in fluids according to claim 1, wherein said plates are constructed and arranged in a triangular configuration.

6. The device for enhancing hydrodynamic cavitation in fluids according to claim 1, wherein said inner surface of said depending flange further defined as having a substantially conjugate shape as said outer surface of said flow-through chamber.

7. The device for enhancing hydrodynamic cavitation in fluids according to claim 1, wherein plurality of said orifices are constructed and arranged perpendicular to the said top surface of said plate.

8. The device for enhancing hydrodynamic cavitation in fluids according to claim 1, wherein each said orifice is sized to control the velocity of fluid flow.

9. The device for enhancing hydrodynamic cavitation in fluids according to claim 1, wherein each said orifice is sized to provide a predetermined pressure drop for a volume of fluid flow.

10. The device for enhancing hydrodynamic cavitation in fluids according to claim 1, wherein said distal end of said plates is positioned in said flow-through chamber to create an unrestricted passageway along the central axis of said flow through chamber.

11. The device for enhancing hydrodynamic cavitation in fluids according to claim 1, wherein said plates are releasably secured to said slot.

12. The device for enhancing hydrodynamic cavitation in fluids according to claim 1, wherein said slots have a substantially conjugate shape as said proximate end of said plate.

13. The device for enhancing hydrodynamic cavitation in fluids according to claim 1, wherein said plates extend radially inward through said slots at an oblique angle with respect to the longitudinal axis of said flow through chamber.

14. The device for enhancing hydrodynamic cavitation in fluids according to claim 1, wherein said top surface forms a depending flange positioned to cooperate with the outer surface of said flow through chamber.

15. The device for enhancing hydrodynamic cavitation in fluids according to claim 1, wherein said plates are anchored by attaching said flange to said outer surface of said flow through chamber by weldment.

* * * * *